US010607577B2

(12) United States Patent
Ohba et al.

(10) Patent No.: US 10,607,577 B2
(45) Date of Patent: Mar. 31, 2020

(54) SUPPORT ASSEMBLY AND KEYBOARD APPARATUS

(71) Applicant: YAMAHA CORPORATION, Hamamatsu-shi (JP)

(72) Inventors: Akito Ohba, Hamamatsu (JP); Shunsuke Ichiki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/952,826

(22) Filed: Apr. 13, 2018

(65) Prior Publication Data

US 2018/0233114 A1 Aug. 16, 2018

Related U.S. Application Data

(63) Continuation of application No. PCT/JP2016/078151, filed on Sep. 26, 2016.

(30) Foreign Application Priority Data

Oct. 16, 2015 (JP) ..... 2015-204534

(51) Int. Cl.

| | |
|---|---|
| ***G10C 3/12*** | (2006.01) |
| ***G10B 3/12*** | (2006.01) |
| ***G10H 1/34*** | (2006.01) |
| ***G10C 3/23*** | (2019.01) |
| ***G10C 3/168*** | (2019.01) |

(52) U.S. Cl.

CPC ..... *G10B 3/12* (2013.01); *G10C 3/168* (2013.01); *G10C 3/23* (2019.01); *G10H 1/34* (2013.01); *G10H 1/346* (2013.01); *G10H 2220/305* (2013.01)

(58) Field of Classification Search

CPC ..... G10B 3/12; G10C 3/168; G10C 3/225; G10H 1/34; G10H 1/346; G10H 2220/305

USPC ..... 84/433

See application file for complete search history.

(56) References Cited

U.S. PATENT DOCUMENTS 1,992,939 A * 3/1935 Dasenbrook ..... G10C 3/22 84/239

FOREIGN PATENT DOCUMENTS

| | | | | |
|---|---|---|---|---|
| GB | 463714 A | * | 4/1937 | ..... G10C 3/168 |
| JP | 2002202773 A | * | 7/2002 | |
| JP | 2005292361 A | | 10/2005 | |

OTHER PUBLICATIONS

International Search Report issued in International Application No. PCT/JP2016/078151 dated Dec. 6, 2016. English translation provided.

Written Opinion issued in International Application No. PCT/JP2016/078151 dated Dec. 6, 2016.

* cited by examiner

*Primary Examiner* — Jianchun Qin

(74) *Attorney, Agent, or Firm* — Rossi, Kimms & McDowell LLP

(57) ABSTRACT

A support assembly according to one embodiment of the present invention is provided, the support assembly including a jack rotatably supported by a support; a repetition lever rotatably supported with respect to the support; a protrusion disposed at an intersecting portion of the jack and the repetition lever; and a protrusion receiving portion for receiving the protrusion; wherein the protrusion receiving portion defines a movable range of the protrusion and limits a rotation range of the jack.

9 Claims, 9 Drawing Sheets

SUPPORT ASSEMBLY AND KEYBOARD APPARATUS

CROSS REFERENCE TO RELATED APPLICATIONS

This application is based upon and claims the benefit of priority from the prior Japanese Patent Application No. 2015-204534, filed on Oct. 16, 2015, and PCT Application No. PCT/JP2016/078151, filed on Sep. 26, 2016, the entire contents of which are incorporated herein by reference.

FIELD

The present invention relates to a support assembly for use in a keyboard apparatus.

BACKGROUND

Conventional acoustic pianos such as grand pianos and upright pianos are configured of many components. Also, since assembling these components is very complex, the assembling operation takes a long time. In particular, since an action mechanism provided for each key requires many components, its assembling operation is very complex.

For example, in an action mechanism described in Japanese Patent Application Laid-Open No. 2005-292361, a plurality of components operate together, and key operation by key pressing and key releasing is transmitted to a hammer. In particular, a support assembly configuring part of the action mechanism operates with various components assembled together. The support assembly has not only a mechanism which achieves string hammering by the hammer in accordance with key pressing but also an escapement mechanism for releasing a force transmitted to the hammer by key operation immediately before string hammering. This mechanism is an important mechanism for the basic operation of an acoustic piano. In particular, in a grand piano, a double escapement mechanism with a repetition lever and a jack combined together is generally adopted.

The operation of the action mechanism provides a sense (hereinafter referred to as a touch feeling) to a finger of a player through the key. In particular, the structure of the support assembly has an important influence on the touch feeling. For example, the touch feeling by the operation of the escapement mechanism is called let-off.

SUMMARY

Since the number of respective components making up the support assembly is large, the manufacturing period is prolonged, and manufacturing cost increased. Therefore, to reduce manufacturing cost, it is desired to simply decrease the number of components and simplify the structure. However, if the structure of the support assembly is changed, the touch feeling at the time of key operation is greatly changed. Therefore, it is difficult to decrease the expense of manufacturing an acoustic piano.

One object of the present invention is to reduce manufacturing cost of a support assembly while decreasing a change in touch feeling at the time of key operation, compared with a keyboard apparatus of an acoustic piano.

According to one embodiment of the present invention, a support assembly is provided, the support assembly including a jack rotatably supported by a support; a repetition lever rotatably supported with respect to the support; a protrusion disposed at an intersecting portion of the jack and the repetition lever; and a protrusion receiving portion for receiving the protrusion; wherein the protrusion receiving portion defines a movable range of the protrusion and limits a rotation range of the jack.

The protrusion may define a movable range of the protrusion receiving portion and limit a rotation range of the repetition lever.

A range of the protrusion receiving portion in which the protrusion moves may define a movable range of the jack at time of key pressing and time of key releasing.

The protrusion receiving portion may be a groove or an opening, and a contacting surface to be brought into contact with the protrusion may be made from a soft material.

The protrusion may be disposed on the jack, and the protrusion receiving portion may be disposed on the repetition lever.

The support may include a resin made structure.

The jack may include a resin made structure.

According to one embodiment of the present invention, a keyboard apparatus is provided, the keyboard apparatus including a plurality of support assemblies according to any one of the above; a key disposed for each of the support assemblies and provided for rotating the support; and a sound emission mechanism for emitting sound in accordance with pressing of the key.

The sound emission mechanism may include a sound source unit for generating a sound signal according to a key pressing operation.

The sound emission mechanism may include a string generating a sound by being struck by a hammer in accordance with key pressing operation.

REFERENCE SIGNS LIST

Figure 1:
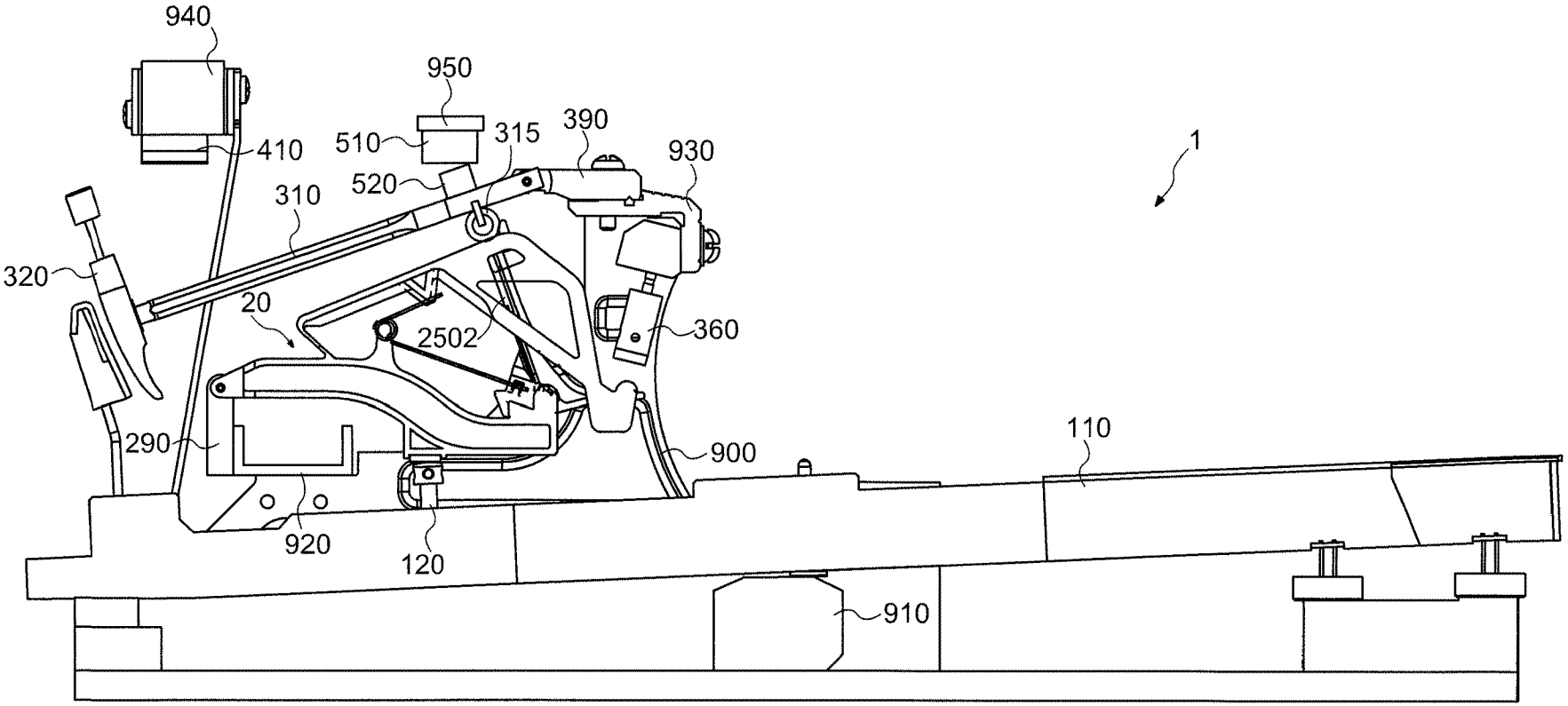
FIG. 1 is a side view depicting a structure of a keyboard apparatus in a first embodiment of the present invention.

1 . . . keyboard apparatus, 20 . . . support assembly, 20A . . . support assembly, 20B . . . support assembly, 50 . . . sound emission mechanism, 110 . . . key, 120 . . . capstan screw, 210 . . . support, 211 . . . guide portion, 212 . . . support heel, 216 . . . stopper, 218 . . . spring support portion, 220 . . . flexible portion, 240 . . . repetition lever, 240A . . . repetition lever, 240B . . . repetition lever, 242 . . . spring contact portion, 244 . . . extension portion, 246 . . . rib, 250 . . . jack, 256 . . . projecting portion, 280 . . . coil spring, 290 . . . support flange, 310 . . . hammer shank, 315 . . . hammer roller, 320 . . . hammer, 360 . . . regulating button, 390 . . . shank flange, 410 . . . hammer stopper, 510 . . . sensor, 520 . . . shielding plate, 550 . . . signal converting unit, 560 . . . sound source unit, 570 . . . output unit, 900 . . . bracket, 910 . . . balance rail, 920 . . . support rail, 930 . . . shank rail, 940 . . . hammer stopper rail, 950 . . . sensor rail, 2101 . . . first main body portion, 2102 . . . bent portion, 2103 . . . second main body portion, 2105 . . . jack support portion, 2109 . . . through hole, 2112 . . . first member, 2114 . . . second member, 2441 . . . inner portion, 2442 . . . outer portion, 2443 . . . coupling portion, 2450 . . . protrusion receiving portion, 2450A . . . protrusion receiving portion, 2450B . . . protrusion receiving portion, 2451 . . . contacting position, 2453 . . . contacting position, 2502 . . . large jack (first jack), 2504 . . . small jack (second jack), 2505 . . . support connecting portion, 2510 . . . protrusion, 2562 . . . spring contact portion, 2802 . . . first arm, 2804 . . . second arm

DESCRIPTION OF EMBODIMENTS

In the following, a keyboard apparatus including a support assembly in one embodiment of the present invention is described in detail with reference to the drawings. Embodiments described below are merely examples of embodiments of the present invention, and the present invention should not be interpreted to be restricted to these embodiments. Note that, in the drawings referred to in the present embodiments, identical portions or portions having a similar function are provided with a same sign or similar sign (sign with a numeral merely followed by A, B, or the like), and repetitive description thereof may be omitted. Also, for convenience of description, the dimensional ratio in the drawings (such as ratio between respective structures, or a ratio among length) may differ from an actual ratio, and part of the structure may be omitted from the drawings.

First Embodiment

[Structure of Keyboard Apparatus 1]

A keyboard apparatus 1 in a first embodiment of the present invention is an example obtained by applying one example of the support assembly according to the present invention to an electronic piano. To obtain a touch feeling close to a grand piano at the time of key operation, this electronic piano includes a structure similar to a support assembly included in a grand piano. By using FIG. 1, a general outline of the keyboard apparatus 1 according to the first embodiment of the present invention is described.

FIG. 1 is a side view depicting a mechanical structure of the keyboard apparatus according to the first embodiment of the present invention. As depicted in FIG. 1, the keyboard apparatus 1 according to one embodiment of the present invention includes a plurality of keys 110 (in this example, eighty-eight keys) and an action mechanism for each of the keys 110. The action mechanism includes a support assembly 20, a hammer shank 310, a hammer 320, and a hammer stopper 410. Note that while FIG. 1 depicts the case in which the key 110 is white key, the key may be a black key. Also, in the following description, terms representing orientations such as a forward side, a deeper side, upward, downward, and sideward from a player are defined as orientations when the keyboard apparatus is viewed from a player's side. For example, in the example of FIG. 1, the support assembly 20 is disposed on a player's forward side when viewed from the hammer 320, and is disposed upward when viewed from the key 110. Sideward corresponds to a direction in which the keys 110 are arranged.

The key 110 is rotatably supported by a balance rail 910. The key 110 rotates in a range from a rest position depicted in FIG. 1 to an end position. The "rest position" is a key position when the key is not pressed, and the "end position" is a key position when the key is fully pressed. The key 110 includes a capstan screw 120. The support assembly 20 is rotatably connected to a support flange 290, and is resting on the capstan screw 120. The support flange 290 is fixed to a support rail 920. Detailed structure of the support assembly 20 will be described further below. Note that the support flange 290 and the support rail 920 are one example of a frame serving as a reference of rotation of the support assembly 20. The frame may be formed of a plurality of members, such as the support flange 290 and the support rail 920, or may be formed of one member. The frame may be, as with the support rail 920, a rail-shaped member with a long side in the arrangement direction of the keys 110, or may be, as with the support flange 290, an independent member for each key 110.

The hammer shank 310 is rotatably connected to a shank flange 390. The hammer shank 310 includes a hammer roller 315. The hammer shank 310 is mounted on the support assembly 20 via the hammer roller 315. The shank flange 390 is fixed to a shank rail 930. The hammer 320 is fixed to an end of the hammer shank 310. A regulating button 360 is fixed to the shank rail 930. The hammer stopper 410 is fixed to a hammer stopper rail 940 and disposed at a position of regulating rotation of the hammer shank 310.

A sensor 510 is a sensor for measuring the position and moving speed (in particular, speed immediately before the hammer shank 310 collides with the hammer stopper 410) of the hammer shank 310. The sensor 510 is fixed to a sensor rail 950. In this example, the sensor 510 is a photo interrupter. In accordance with the amount of shielding the optical axis of the photo interrupter by a shielding plate 520 fixed to the hammer shank 310, an output value from the sensor 510 is changed. Based on this output value, the position and moving speed of the hammer shank 310 can be measured. Note that a sensor for measuring an operating state of the key 110 may be provided in place of the sensor 510 or together with the sensor 510.

The above-described frame 920, shank rail 930, hammer stopper rail 940, and sensor rail 950 are supported by a bracket 900.

[Structure of Support Assembly 20]

Figure 2:
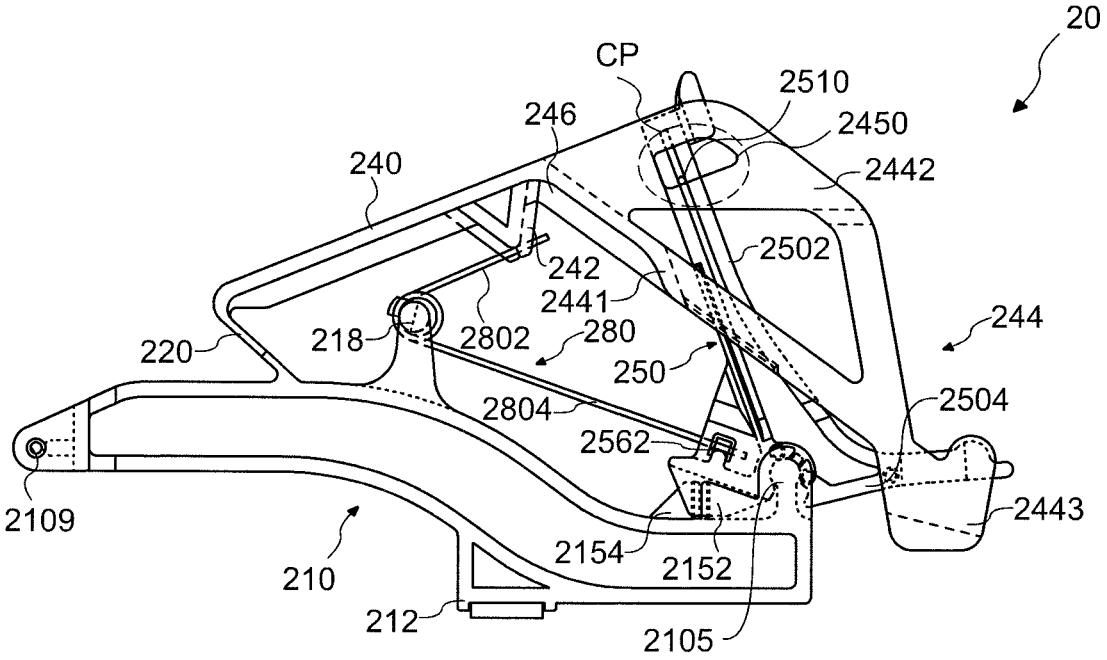
FIG. 2 is a side view depicting the structure of a support assembly in the first embodiment of the present invention.
Figure 3:
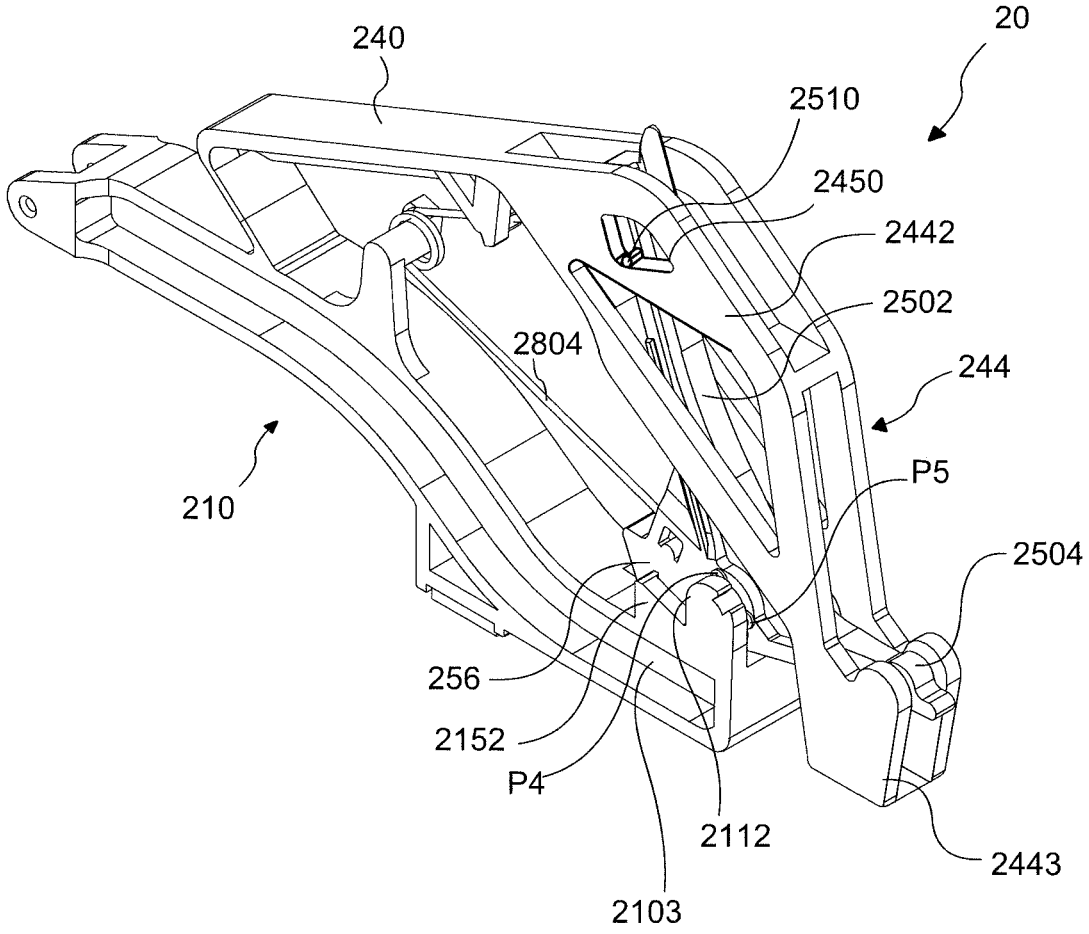
FIG. 3 is a perspective view depicting a structure of the support assembly in the first embodiment of the present invention.
Figure 4A:
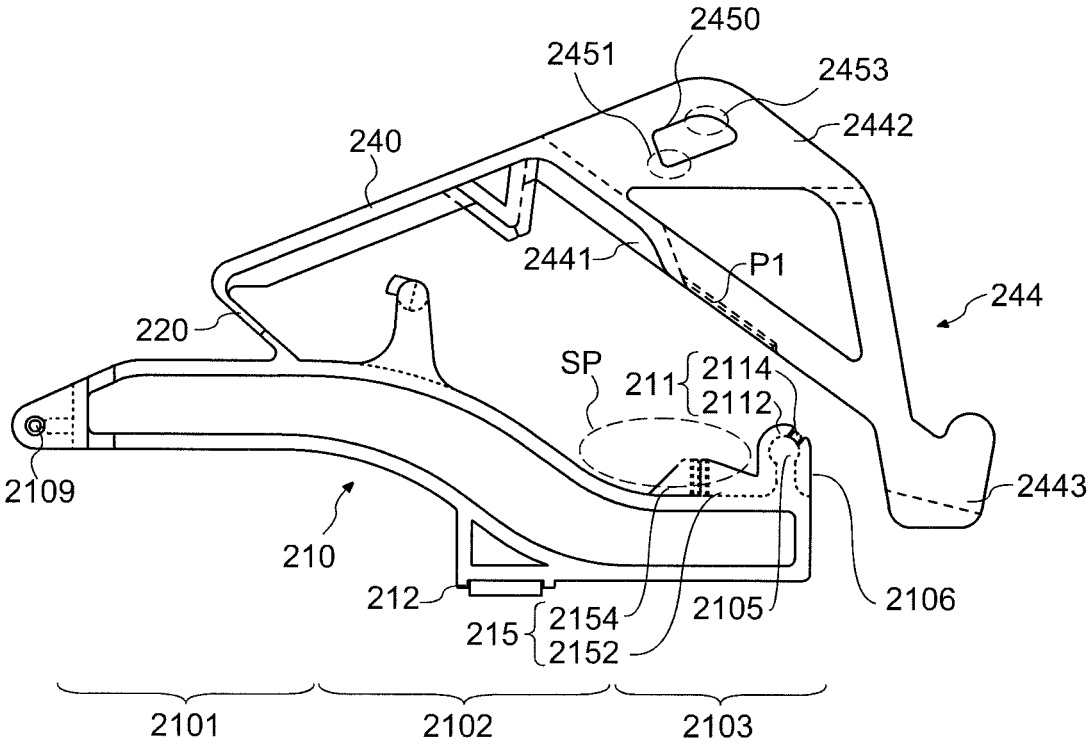
FIG. 4A is a side view depicting a partial structure of the disassembled support assembly in the first embodiment of the present invention.
Figure 4B:
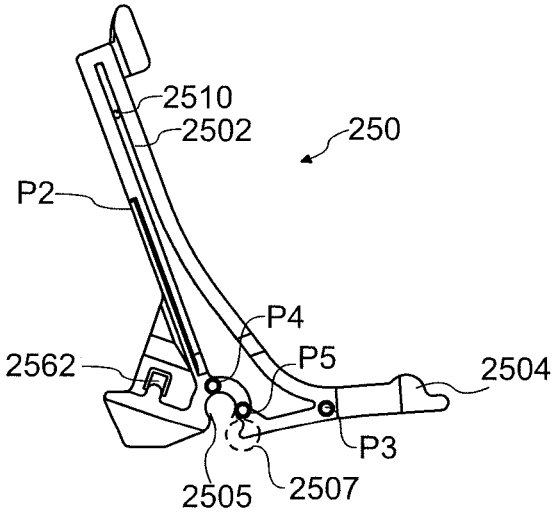
FIG. 4B is a side view depicting a partial structure of the disassembled support assembly in the first embodiment of the present invention.

FIG. 2 is a side view depicting the structure of the support assembly in the first embodiment of the present invention. FIG. 3 is a perspective view depicting the structure of the support assembly in the first embodiment of the present invention. FIGS. 4A and 4B are side views depicting a partial structure of the disassembled support assembly in the first embodiment of the present invention. For easy understanding of the features of each component, FIG. 4A is a drawing in which a jack 250 and a torsion coil spring 280 are excluded from the support assembly 20. FIG. 4B is a drawing only depicting the jack 250.

The support assembly 20 includes a support 210, a repetition lever 240, the jack 250, and the torsion coil spring 280. The support 210 and the repetition lever 240 are coupled together via a flexible portion 220. By the flexible portion 220, the repetition lever 240 is rotatably supported with respect to the support 210. The support assembly 20, except the torsion coil spring 280 and cushioning materials or the like (such as elastic body etc.) provided at a portion which collides with another member, is a resin-made structure manufactured by injection molding. In this example, the support 210 and the repetition lever 240 are integrally formed. Note that the support 210 and the repetition lever 240 may be formed as individual components and be attached or bonded together.

The support 210 has one end side where a through hole 2109 is formed, and has the other end side where a jack support portion 2105 is formed. Between the through hole 2109 and the jack support portion 2105, the support 210 includes a support heel 212 projecting downward and a spring support portion 218 projecting upward. Through the through hole 2109, a shaft supported by the support flange 290 is drawn. With this, the support 210 is rotatably disposed with respect to the support flange 290 and the support rail 920. Therefore, the through hole 2109 serves as a rotation center of the support 210.

The support heel 212 makes contact with the above-described capstan screw 120 at its lower surface. The spring support portion 218 supports the torsion coil spring 280. The jack support portion 2105 rotatably supports the jack 250. Therefore, the jack support portion 2105 serves as a rotation center of the jack 250.

Between the through hole 2109 (rotation center of the support 210) and the jack support portion 2105 (rotation center of the jack 250), a space SP is formed on a jack support portion 2105 side from the support heel 212. For convenience of description, the support 210 is sectioned into regions: a first main body portion 2101, a bent portion 2102, and a second main body portion 2103, from the through hole 2109 side. In this case, by the bent portion 2102 which couples the first main body portion 2101 and the second main body portion 2103 together, the second main body portion 2103 is disposed on a side closer to the key 110 (downward) than the first main body portion 2101. The jack support portion 2105 projects upward from the second main body portion 2103. According to this sectioning, the above-described space SP corresponds to a region interposed between the bent portion 2102 and the jack support portion 2105 above the second main body portion 2103. Also, at an end of the support 210 (an end on a second main body portion 2103 side), a stopper 216 is coupled. The support heel 212 is disposed below the bent portion 2102. Here, it is desired that a distance from the key 110 to the second main body portion 2103 be longer than a distance from the key 110 to the support heel 212 (that is, the length of the capstan screw 120). This makes the capstan screw 120 easily adjustable from a player's side.

To the repetition lever 240, a spring contact portion 242 and an extension portion 244 are coupled. The spring contact portion 242 and the extension portion 244 are extended from the repetition lever 240 toward the support 210 side. The spring contact portion 242 makes contact with a first arm 2802 of the torsion coil spring 280. The repetition lever 240 and the extension portion 244 include two plate-shaped members for interposition from sides of both side surfaces of the jack 250. In this example, the extension portion 244 and the jack 250 slidably make contact with each other in at least part of a space interposed between these two plate-shaped members.

The extension portion 244 includes an inner portion 2441, an outer portion 2442, and a coupling portion 2443. The inner portion 2441 is coupled to the repetition lever 240 on a player's deeper side (flexible portion 220 side) of a large jack (first jack) 2502. At a portion where the inner portion 2441 and the repetition lever 240 are coupled together, a rib 246 is provided. The inner portion 2441 interposes the large jack 2502 to cross to extend to a player's forward side (opposite side to the flexible portion 220) of the large jack 2502. That is, this can also be said that the extension portion 244 crosses the jack 250. At a portion of the intersection between the inner portion 2441 and the large jack 2502, the inner portion 2441 includes a linear-shaped convex portion P1 projecting to a large jack 2502 side.

A protrusion 2510 is disposed at the intersecting portion CP of the jack 250 and the repetition lever 240. Furthermore, a protrusion receiving portion 2450 for receiving the protrusion 2510 is disposed at the intersecting portion CP. The protrusion receiving portion 2450 regulates a movable range of the protrusion 2510 and limits a rotation range of the jack 250.

The outer portion 2442 is coupled to the repetition lever 240 on a player's forward side (opposite side to the flexible portion 220) of the jack 250 (large jack 2502). The inner portion 2441 and the outer portion 2442 are coupled together at the coupling portion 2443. The coupling portion 2443 interposes a small jack (second jack) 2504.

The jack 250 includes the large jack (first jack) 2502 (first jack) and the small jack (second jack) 2504. The jack 250 is rotatably disposed with respect to the support 210. Between the large jack 2502 and the small jack 2504, a support connecting portion 2505 to be rotatably supported by the jack support portion 2105 is formed. The support connecting portion 2505 has a shape surrounding part of the jack support portion 2105, and regulates a rotation range of the jack 250. Also, with the shape of the support connecting portion 2505 and elastic deformation of its material, it is possible to fit the support connecting portion 2505 of the jack 250 into the jack support portion 2105 from above the jack support portion 2105. The large jack 2502 includes a spring contact portion 2562 at its lower side surface. The spring contact portion 2562 makes contact with a second arm 2804 of the torsion coil spring 280.

The large jack 2502 includes linear-shaped convex portions P2 projecting from both side surfaces. The convex portions P2 slidably contact the convex portions P1 of the inner portion 2441 described above. The small jack 2504 includes circular-shaped convex portions P3 projecting from both side surfaces. The convex portions P3 slidably contact an inner surface of the coupling portion 2443 described above. The support connecting portion 2505 includes circular-shaped convex portions P4, P5 at its periphery on the side surface of the jack 250. In this example, the convex portions P4, P5 are provided on a first member 2112 side of both side surfaces, and are not provided on a second member 2114 side. The convex portions P4, P5 slidably contact the first member 2112 of a guide portion 211 disposed at the periphery of the jack support portion 2105.

The contact area can be decreased by bringing the jack 250 and the extension portion 244 into slidable contact by way of the convex portions P1, P2, and P3. Furthermore, the contact area can be decreased by bringing the jack 250 and the guide portion 211 (first member 2112) into slidable contact by way of the convex portions P4, P5 disposed on the side surface of the jack 250. The jack 250 (periphery of support connecting portion 2505) and the second member 2114 are, on the other hand, directly brought into contact and slidably contact. In this example, the second member 2114 has a size same as the convex portions P4, P5, and thus the contact area of the jack 250 (periphery of support connecting portion 2505) and the second member 2114 can be decreased without providing the convex portion. Note that a grease reservoir may be formed by forming a groove portion by a plurality of convex portions P2. Also, a convex portion or groove portion may be formed in a side-surface of the large jack 2502.

In the torsion coil spring 280, the spring support portion 218 is taken as a fulcrum, the first arm 2802 makes contact with the spring contact portion 242, and the second arm 2804 makes contact with the spring contact portion 2562. The first arm 2802 functions as an elastic body which provides a rotational force to the repetition lever 240 via the spring contact portion 242 so as to move a player's side of the repetition lever 240 upward (in a direction away from the support 210). The second arm 2804 functions as an elastic body which provides a rotational force to the jack 250 via the spring contact portion 2562 so as to move the large jack 2502 downward (to a support 210 side).

[Structure of Intersecting Portion CP]

Figure 5A:
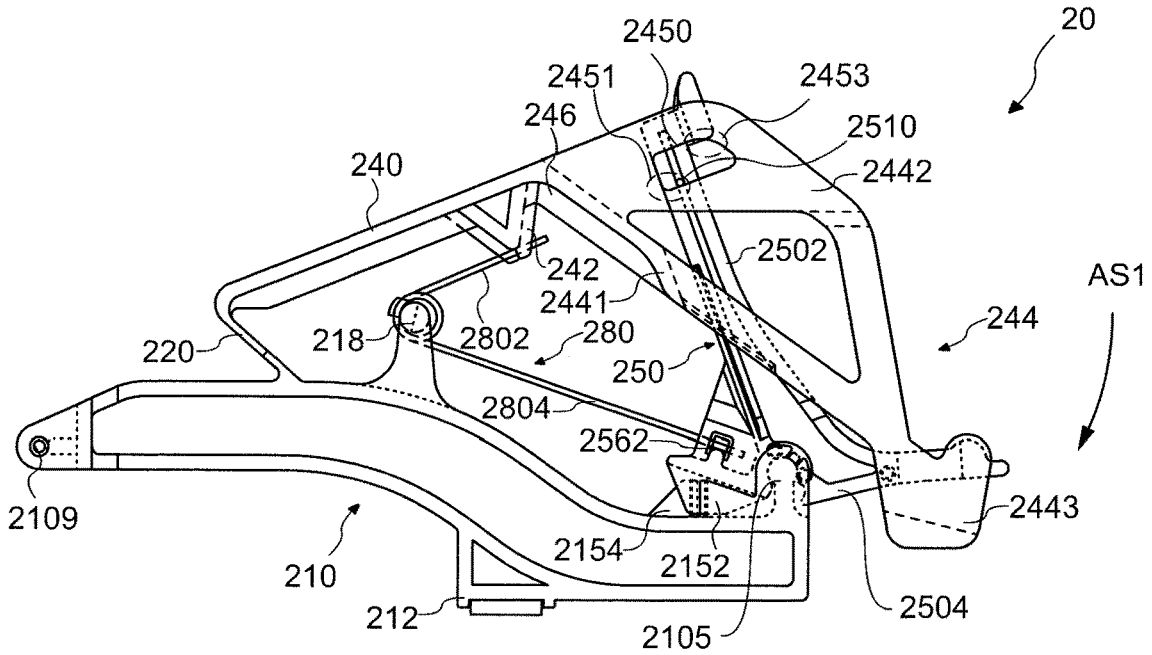
FIG. 5A is a side view for describing movement of the support assembly in the first embodiment of the present invention.
Figure 5B:
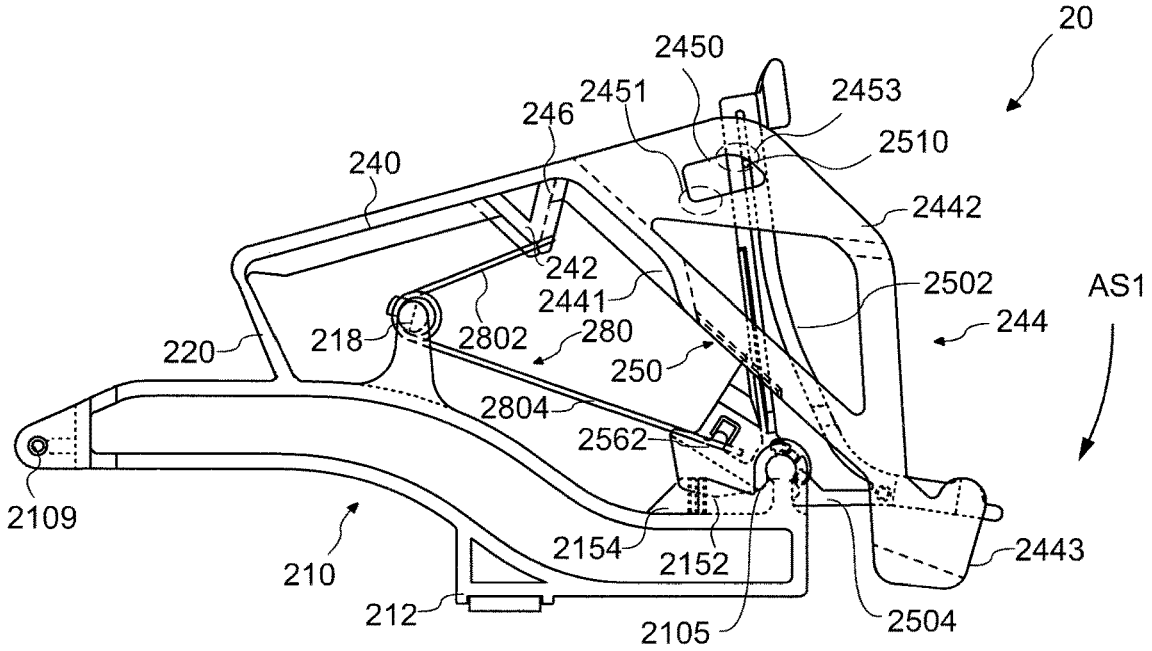
FIG. 5B is a side view for describing movement of the support assembly in the first embodiment of the present invention.

FIGS. 5A and 5B are side views for describing the movement of the support assembly in the first embodiment of the present invention. FIG. 5A is a side view of the support assembly 20 at the time of key releasing, and FIG. 5B is a side view of the support assembly 20 at the time of key pressing. In the support assembly 20, the jack 250 is rotatably supported by the support 210, and the repetition lever 240 is rotatably supported with respect to the support 210. The protrusion 2510 is disposed at the intersecting portion CP of the jack 250 and the repetition lever 240. Furthermore, a protrusion receiving portion 2450 for receiving the protrusion 2510 is disposed at the intersecting portion CP. In FIGS. 5A and 5B, the protrusion 2510 is disposed on the large jack 2502 located at the intersecting portion CP, and the protrusion receiving portion 2450 is disposed at the extension portion 244 connected by being extended from the repetition lever 240 located at the intersecting portion CP. The protrusion receiving portion 2450 defines a movable range of the protrusion 2510. Thus, the rotation range of the jack 250 is limited by the protrusion receiving portion 2450.

In the present embodiment, the rotation range of the jack 250 is determined to a predetermined range by disposing the protrusion 2510 and the protrusion receiving portion 2450 at the intersecting portion CP of the jack 250 and the repetition lever 240. In other words, the range in a direction from the deeper side toward the forward side of the player of the protrusion receiving portion 2450 can regulate the movement of the jack 250. Furthermore, the movable range of the repetition lever 240 is determined to a predetermined range by disposing the protrusion 2510 and the protrusion receiving portion 2450 at the intersecting portion CP of the jack 250 and the repetition lever 240. In other words, an up and down range of the protrusion receiving portion 2450 can regulate the movement of the repetition lever. Furthermore, the rotation range of the jack 250 can be simply and accurately determined when assembling the jack 250 to the repetition lever 240 by disposing the protrusion 2510 and the protrusion receiving portion 2450 at the intersecting portion CP of the jack 250 and the repetition lever 240.

The position (hereinafter sometimes referred to as initial position) of the repetition lever 240 when the key 110 is at the rest position is as shown in FIG. 5A. As described above, the repetition lever 240 is rotatably connected with respect to the support 210 by the flexible portion 220, and is applied with a force to rotate in a direction opposite a direction AS1 by the first arm 2802. At this time, the protrusion 2510 is located at a contacting position 2451 of the protrusion receiving portion 2450.

At the time of key pressing, the coupling portion 2443 is pressed down with the small jack 2504 by the regulating button 360, and the repetition lever 240 is subjected to the rotational force in the direction AS1. As shown in FIG. 5B, the protrusion 2510 is brought into contact with the protrusion receiving portion 2450 at a contacting position 2453. As a result, the repetition lever 240 cannot rotate in the direction AS1. In other words, one side of the rotation range of the repetition lever 240 is regulated by the contacting position 2453 of the protrusion 2510 and the protrusion receiving portion 2450. That is, as the protrusion 2510 regulates the movable range of the protrusion receiving portion 2450, the movable range of the repetition lever 240 at the time of key pressing is limited.

Furthermore, at the time of key releasing, the repetition lever 240 is subjected to a rotational force in a direction opposite the direction AS1 by the first arm 2802. As shown in FIG. 5A, the protrusion 2510 is brought into contact with the protrusion receiving portion 2450 at the contacting position 2451. As a result, the repetition lever 240 cannot rotate in the direction opposite the direction AS1. In other words, the other side of the rotation range of the repetition lever 240 is regulated by the contacting position 2451 of the protrusion 2510 and the protrusion receiving portion 2450. That is, the movable range of the repetition lever 240 at the time of key releasing is regulated by the range of the protrusion receiving portion 2450 in which the protrusion 2510 moves. Thus, the repetition lever 240 can be prevented from being returned in excess at the time of key releasing.

In the present embodiment, the movable range of the repetition lever 240 is determined to the predetermined range by disposing the protrusion 2510 and the protrusion receiving portion 2450 at the intersecting portion CP of the jack 250 and the repetition lever 240. In other words, the up and down range of the protrusion receiving portion 2450 can regulate the movement in an up and down direction of the repetition lever. Therefore, the rotation range of the repetition lever 240 at the time of key pressing and key releasing can be easily and accurately determined by disposing the protrusion 2510 and the protrusion receiving portion 2450 at the intersecting portion CP of the jack 250 and the repetition lever 240.

Next, the rotation of the jack 250 will be described. The position (hereinafter sometimes referred to as initial position) of the jack 250 when the key 110 is at the rest position is as shown in FIG. 5A. As described above, the jack 250 is rotatably connected with respect to the jack support portion 2105, and is applied with a force to rotate in a direction opposite the direction AS1 by the second arm 2804. At this time, the protrusion 2510 is located at the contacting position 2451 of the protrusion receiving portion 2450.

Figure 6:
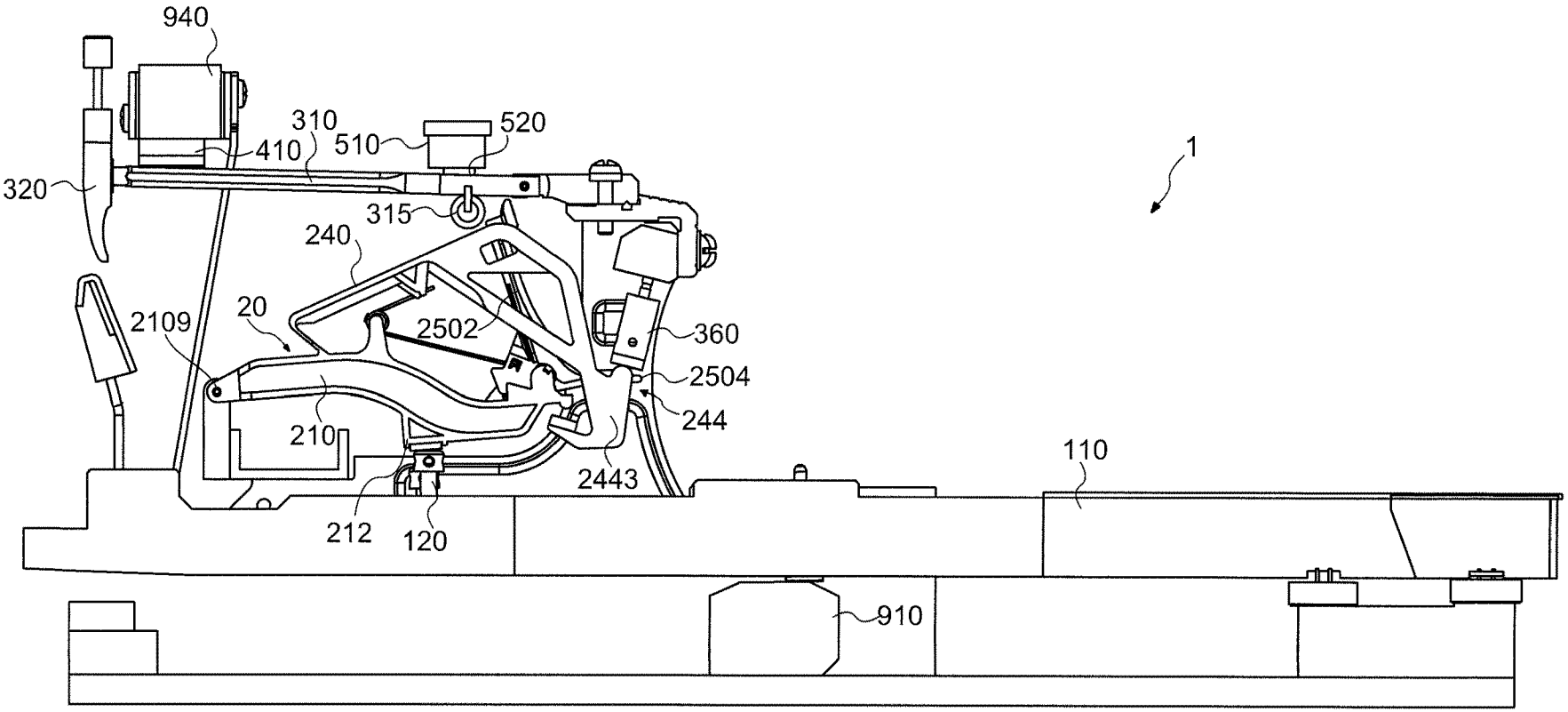
FIG. 6 is a side view for describing movement of the support assembly arranged in a keyboard apparatus in the first embodiment of the present invention.

At the time of key pressing, the small jack 2504 is pressed down by the regulating button 360, and the jack 250 is subjected to the rotational force in the direction AS1 (see FIG. 6). As shown in FIG. 5B, the protrusion 2510 is brought into contact with the protrusion receiving portion 2450 at the contacting position 2453. As a result, the jack 250 cannot rotate in the direction AS1. In other words, one side of the rotation range of the jack 250 is regulated by the contacting position 2453 of the protrusion 2510 and the protrusion receiving portion 2450. That is, the movable range of the jack 250 at the time of key pressing is regulated by the range of the protrusion receiving portion 2450 in which the protrusion 2510 moves.

Furthermore, at the time of key releasing, the jack 250 is subjected to a rotational force in a direction opposite the direction AS1 by the second arm 2804. As shown in FIG. 5A, the protrusion 2510 is brought into contact with the protrusion receiving portion 2450 at the contacting position 2451. As a result, the jack 250 cannot rotate in the direction opposite the direction AS1. In other words, the other side of the rotation range of the jack 250 is regulated by the contacting position 2451 of the protrusion 2510 and the protrusion receiving portion 2450. That is, the movable range of the jack 250 at the time of key releasing is regulated by the range of the protrusion receiving portion 2450 in which the protrusion 2510 moves. Thus, the jack 250 can be prevented from being returned in excess at the time of key releasing.

In the present embodiment, the movable range of the jack 250 is determined to the predetermined range by disposing the protrusion 2510 and the protrusion receiving portion 2450 at the intersecting portion CP of the jack 250 and the repetition lever 240. In other words, the range in a direction from the deeper side toward the forward side of the player of the protrusion receiving portion 2450 can regulate the movement of the jack 250. Furthermore, the position of the jack 250 can be easily and accurately determined with respect to the direction from the deeper side toward the forward side of the player when assembling the jack 250 to the repetition lever 240 by disposing the protrusion 2510 and the protrusion receiving portion 2450 at the intersecting portion CP of the jack 250 and the repetition lever 240.

In FIGS. 5A and 5B, an example in which the protrusion 2510 is disposed on the jack 250, and the protrusion receiving portion 2450 is disposed on the repetition lever 240 has been shown, but the present invention is not limited thereto. The protrusion may be disposed on the repetition lever and the protrusion receiving portion may be disposed on the jack. However, when disposing the protrusion receiving portion on the jack, the large jack 2502 tends to become large and heavy, thus affecting the strength and the touch feeling (weight) of the jack. Thus, the design is restricted if the protrusion receiving portion is provided on the jack. Therefore, in the present embodiment, it is preferable to dispose the protrusion 2510 on the jack 250 and dispose the protrusion receiving portion 2450 on the repetition lever 240. This can guarantee the strength of the jack and the touch feeling (weight). Furthermore, the movable range of the jack at the time of assembly can be increased and the operability can be enhanced by disposing the protrusion receiving portion 2450 on the repetition lever 240.

Furthermore, in one embodiment of the present invention, a contacting surface at the contacting position 2451 and the contacting position 2453 of the protrusion receiving portion 2450 to be brought into contact with the protrusion 2510 is preferably made from a soft material. The impact at the time of contact is absorbed when the protrusion 2510 is brought into contact with the contacting surface made from a soft material. Noise at the time of contact between the protrusion 2510 and the protrusion receiving portion 2450 thus can be further reduced. Note that in the present embodiment, similar effects can be obtained even if the surface of the protrusion 2510 is made from a soft material.

In the conventional support assembly, a felt needed to be attached to a contact portion with respect to the jack in the repetition lever to absorb impact and reduce noise at the time of contact between the jack and the repetition lever. However, since an attaching position of the felt is an opening inner surface of the repetition lever, the attaching task becomes cumbersome. Furthermore, although the felt is a member that needs to be replaced by temporal degradation, and the like, the replacement task is cumbersome due to the problem of the attaching position of the felt. In the present invention, on the other hand, the attaching task of the felt to the repetition lever as in the prior art is not involved as the contacting surface of the protrusion receiving portion 2450 to be brought into contact with the protrusion 2510 is made from a soft material.

[Operation of Support Assembly 20]

Next, the movement of the support assembly 20 is described when the key 110 is pressed down from the rest position (FIG. 1) to the end position.

FIG. 6 is a side view for describing movement of the support assembly in the first embodiment of the present invention. When the key 110 is pressed down to the end position, the capstan screw 120 pushes up the support heel 212 to rotate the support 210, with the axis of the through hole 2109 taken as a rotation center. When the support 210 rotates to move upward, the large jack 2502 pushes up the hammer roller 315 to cause the hammer shank 310 to collide with the hammer stopper 410. Note that this collision corresponds to string hammering by a hammer in a general grand piano.

Immediately before this collision, while upward movement of the small jack 2504 is regulated by the regulating button 360, the support 210 (jack support portion 2105) further ascends. Therefore, the large jack 2502 rotates so as to go off from the hammer roller 315. Here, by the regulating button 360, upward movement of the coupling portion 2443 is also regulated. In this case, the small jack 2504 rotates to make contact with the vicinity of a connecting portion with the support 210 of the jack support portion 2105. In the present invention, the movable range of the repetition lever 240 is limited and the rotation range of the jack 250 is determined to the predetermined range by disposing the protrusion 2510 and the protrusion receiving portion 2450 at the intersecting portion CP of the jack 250 and the repetition lever 240. In this example, the regulating button 360 has also a function of a repetition regulating screw in the action mechanism in a general grand piano.

This regulates upward movement of the repetition lever 240, which rotates so as to approach the support 210. With these operations, a double escapement mechanism is achieved. FIG. 6 is a drawing depicting this state. Note that, when the key 110 is being returned to the rest position, the hammer roller 315 is supported by the repetition lever 240, and the large jack 2502 is returned below the hammer roller 315. A rotational force to cause the large jack 2502 to be returned below the hammer roller 315 is provided by the second arm 2804.

The double escapement is thus realized in an easier configuration compared to the support assembly used in a general grand piano, and the manufacturing cost can be reduced while suppressing the influence on the touch feeling.

[Sound Emission Mechanism of Keyboard Apparatus 1]

As described above, the keyboard apparatus 1 is an example of application to an electronic piano. The operation of the key 110 is measured by the sensor 510, and a sound in accordance with the measurement result is outputted.

Figure 7:
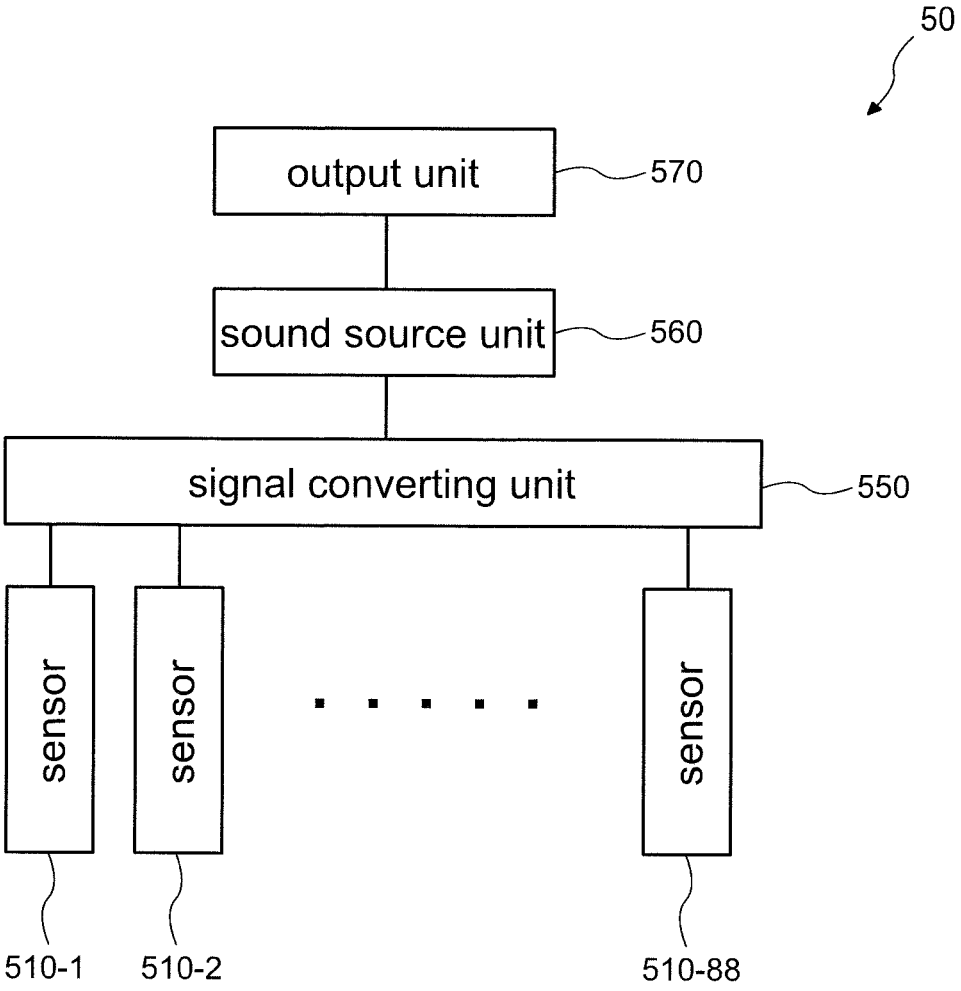
FIG. 7 is a block diagram depicting a structure of a sound emission mechanism of the keyboard apparatus in the first embodiment of the present invention.

FIG. 7 is a block diagram depicting the structure of a sound emission mechanism of the keyboard apparatus according to the first embodiment of the present invention. A sound emission mechanism 50 of the keyboard apparatus 1 includes the sensors 510 (sensors 510-1, 510-2, . . . 510-88 for the eighty-eight keys 110), a signal converting unit 550, a sound source unit 560, and an output unit 570. The signal converting unit 550 obtains an electric signal outputted from the sensor 510, and generates and outputs an operation signal in accordance with an operating state in each key 110. In this example, the operation signal is a MIDI-format signal. Therefore, in accordance with the timing when the hammer shank 310 collides with the hammer stopper 410 by key-pressing operation, the signal converting unit 550 outputs Note ON. Here, a key number indicating which of the eighty-eight keys 110 has been operated and velocity for a speed immediately before the collision are also outputted in association with Note ON. On the other hand, when key-releasing operation is performed, in accordance with the timing when string vibrations are stopped by a damper in the case of a grand piano, the signal converting unit 550 outputs the key number and Note OFF in association with each other. To the signal converting unit 550, a signal for another operation such as one on a pedal may be inputted and reflected to the operation signal. The sound source unit 560 generates a sound signal based on the operation signal outputted from the signal converting unit 550. The output unit 570 is a loudspeaker or terminal which outputs the sound signal generated by the sound source unit 560.

Second Embodiment

In the first embodiment, an example of defining the movable range of the protrusion 2510 by disposing a substantially trapezoidal protrusion receiving portion 2450 has been described, and now, in a second embodiment, an example of disposing a groove as the protrusion receiving portion will be described. A protrusion receiving portion 2450A according to the second embodiment will be described for an example of disposing the protrusion receiving portion 2450A of a C-shape having three sides.

Figure 8A:
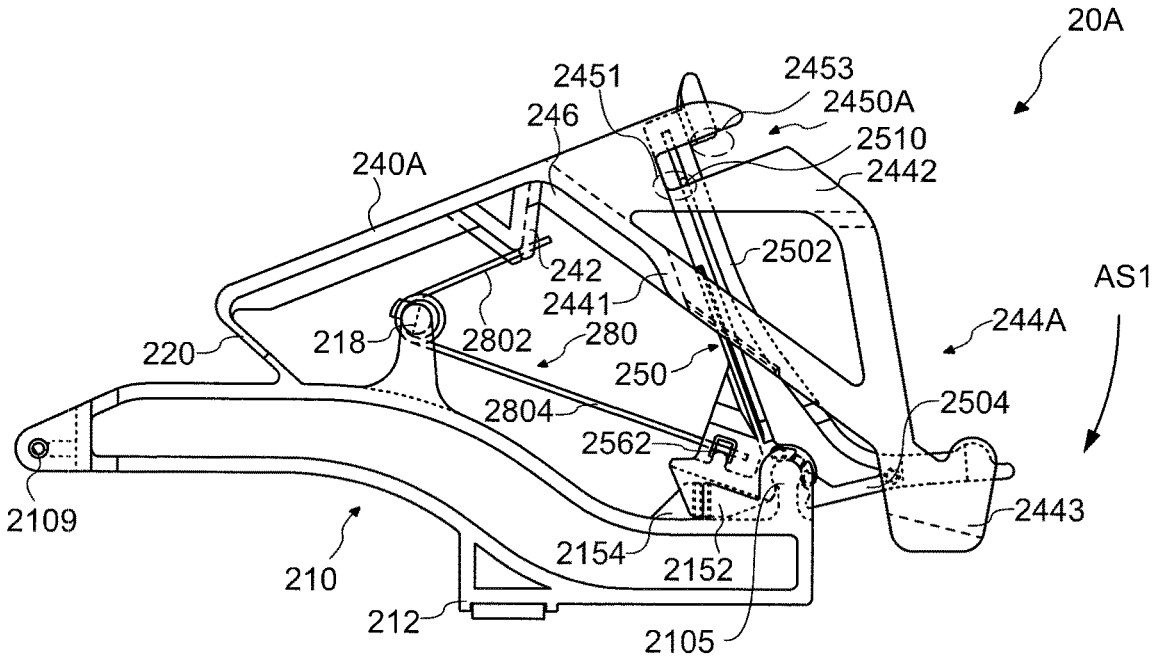
FIG. 8A is a side view for describing movement of a support assembly in a second embodiment of the present invention.
Figure 8B:
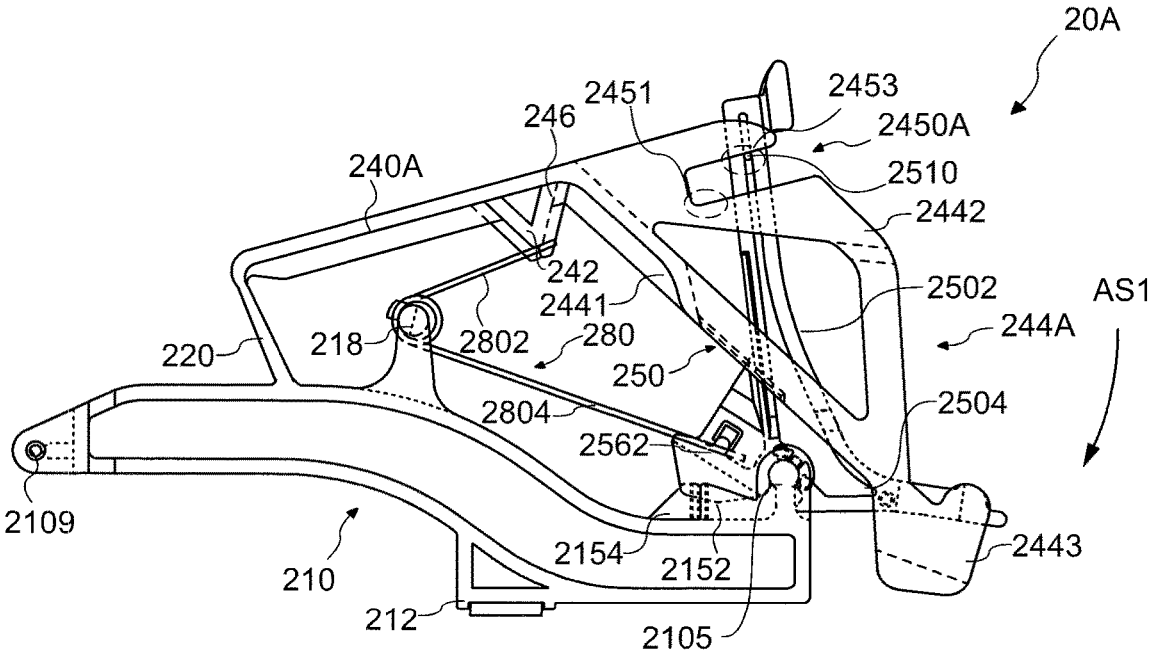
FIG. 8B is a side view for describing movement of a support assembly in a second embodiment of the present invention.

FIGS. 8A and 8B are side views depicting a structure of a support assembly 20A according to the second embodiment of the present invention. FIG. 8A is a side view of the support assembly 20A when the key 110 is at the rest position. FIG. 8B is a side view of the support assembly 20A at the time of key pressing. In the support assembly 20A, the jack 250 is rotatably supported by the support 210, and a repetition lever 240A is rotatably supported with respect to the support 210. The protrusion 2510 is disposed at the intersecting portion CP of the jack 250 and the repetition lever 240A. The protrusion receiving portion 2450A for receiving the protrusion 2510 is also disposed at the intersecting portion CP. In FIGS. 8A and 8B, the protrusion 2510 is disposed on the large jack 2502 located at the intersecting portion CP, and the protrusion receiving portion 2450A is disposed on an extension portion 244A connected by being extended from the repetition lever 240A located at the intersecting portion CP. The protrusion receiving portion 2450A defines a movable range of the protrusion 2510. Thus, the rotation range of the jack 250 is limited by the protrusion receiving portion 2450A.

In the present embodiment, the rotation range of the jack 250 is determined to a predetermined range by disposing the protrusion 2510 and the protrusion receiving portion 2450A at the intersecting portion CP of the jack 250 and the repetition lever 240A. In the present embodiment, a side for receiving the protrusion 2510 is not arranged at the position on the player's forward side in the protrusion receiving portion 2450A. However, as shown in FIG. 8B, the protrusion 2510 is brought into contact with the upper side of the protrusion receiving portion 2450A by the rotation of the jack 250 and the repetition lever 240A. The range in a direction from the deeper side toward the forward side of the player of the protrusion receiving portion 2450A thus can regulate the movement of the jack 250. Furthermore, the movable range of the repetition lever 240A is determined to a predetermined range by disposing the protrusion 2510 and the protrusion receiving portion 2450A at the intersecting portion CP of the jack 250 and the repetition lever 240A. In other words, an up and down range of the protrusion receiving portion 2450A can regulate the movement of the repetition lever. Furthermore, the rotation range of the jack 250 can be simply and accurately determined when assembling the jack 250 to the repetition lever 240A by disposing the protrusion 2510 and the protrusion receiving portion 2450A at the intersecting portion CP of the jack 250 and the repetition lever 240A.

Third Embodiment

In a third embodiment, an example of disposing a protrusion receiving portion 2450B having an n shape without one side on a lower side and having three sides will be described. In other words, the protrusion receiving portion 2450B according to the third embodiment has an opening on a downward side.

Figure 9A:
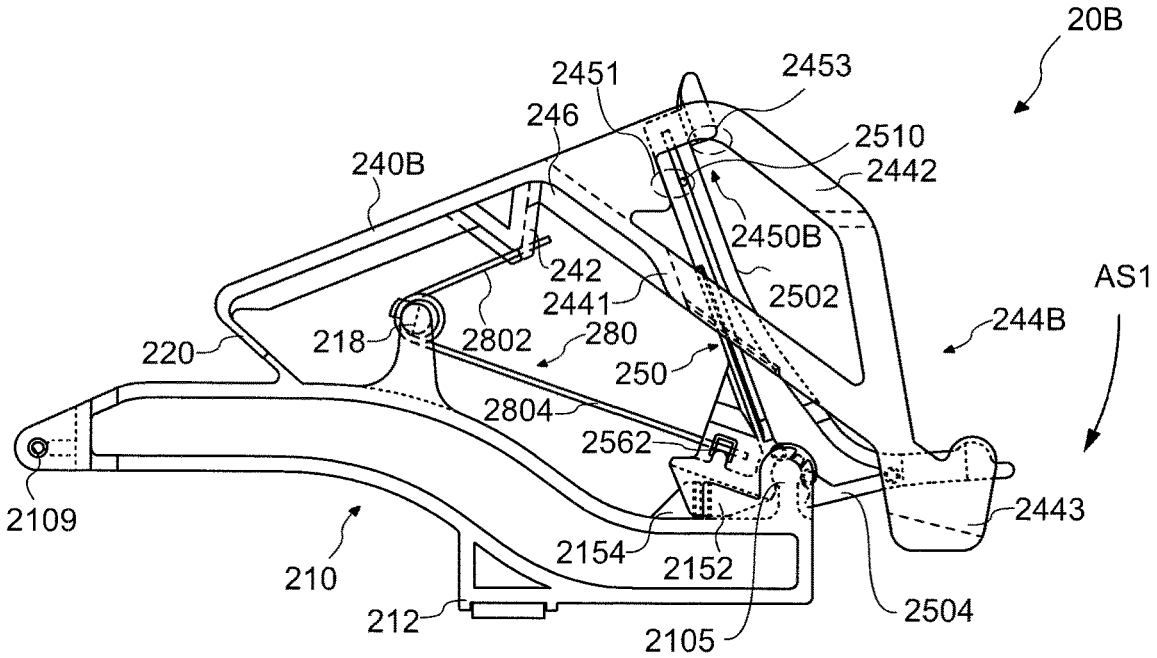
FIG. 9A is a side view for describing movement of a support assembly in a third embodiment of the present invention.
Figure 9B:
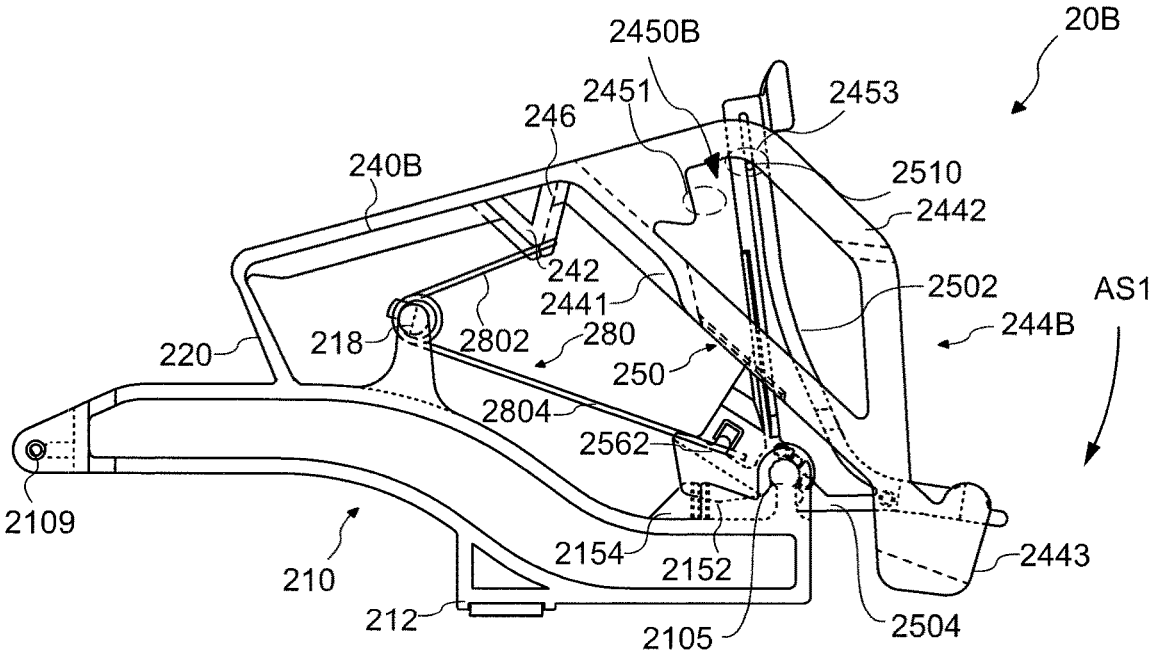
FIG. 9B is a side view for describing movement of a support assembly in a third embodiment of the present invention.

FIGS. 9A and 9B are side views depicting a structure of a support assembly 20B according to the third embodiment of the present invention. FIG. 9A is a side view of the support assembly 20B when the key 110 is at the rest position, and FIG. 9B is a side view of the support assembly 20B at the time of key pressing. In the support assembly 20B, the jack 250 is rotatably supported by the support 210, and a repetition lever 240B is rotatably supported with respect to the support 210. The protrusion 2510 is disposed at the intersecting portion CP of the jack 250 and the repetition lever 240B. The protrusion receiving portion 2450B for receiving the protrusion 2510 is also disposed at the intersecting portion CP. In FIGS. 9A and 9B, the protrusion 2510 is disposed on the large jack 2502 located at the intersecting portion CP, and the protrusion receiving portion 2450B is disposed on an extension portion 244B connected by being extended from the repetition lever 240B located at the intersecting portion CP. The protrusion receiving portion 2450B defines a movable range of the protrusion 2510. Thus, the rotation range of the jack 250 is limited by the protrusion receiving portion 2450B.

In the present embodiment, the rotation range of the jack 250 is determined to a predetermined range by disposing the protrusion 2510 and the protrusion receiving portion 2450B at the intersecting portion CP of the jack 250 and the repetition lever 240B. In the present embodiment, a side for receiving the protrusion 2510 is not arranged at the position on the lower side of the repetition lever 240B in the protrusion receiving portion 2450B. However, as shown in FIG. 9B, the protrusion 2510 is brought into contact with the upper side of the protrusion receiving portion 2450B by the rotation of the jack 250 and the repetition lever 240B. The range in a direction from the deeper side toward the forward side of the player of the protrusion receiving portion 2450B thus can regulate the movement of the jack 250. Furthermore, when the jack 250 and the repetition lever 240B are rotated in a direction opposite the direction AS1 at the time of key releasing, the jack 250 can be prevented from being returned in excess by the side on the player's deeper side of the protrusion receiving portion 2450B.

Furthermore, the movable range of the repetition lever 240B is determined to a predetermined range by disposing the protrusion 2510 and the protrusion receiving portion 2450B at the intersecting portion CP of the jack 250 and the repetition lever 240B. In other words, an up and down range of the protrusion receiving portion 2450B can regulate the movement of the repetition lever. Furthermore, the rotation range of the jack 250 can be simply and accurately determined when assembling the jack 250 to the repetition lever 240B, by disposing the protrusion 2510 and the protrusion receiving portion 2450B at the intersecting portion CP of the jack 250 and the repetition lever 240B.

In each embodiment described above, an electronic piano is described as an example of a keyboard apparatus to which a support assembly is applied. On the other hand, the support assembly of the above-described embodiments can be applied to a grand piano (acoustic piano). In this case, the sound emission mechanism corresponds to a hammer and a string. The string generates a sound by being struck by a hammer in accordance with the key pressing operation.

According to one embodiment of the present invention, the manufacturing cost of the support assembly can be reduced while decreasing a change in touch feeling at the time of key operation, compared with a keyboard apparatus of an acoustic piano.

What is claimed is:

1. A support assembly comprising a jack rotatably supported by a support;

a repetition lever rotatably supported with respect to the support and including a through-hole accommodating a portion of the jack;

a protrusion disposed on the jack and at an intersecting portion of the jack and the repetition lever, the protrusion projecting perpendicular to a rotating surface of the jack; and a protrusion receiving portion for receiving the protrusion, the protrusion receiving portion being disposed on the repetition lever and being different from the through-hole of the repetition lever accommodating the portion of the jack, wherein the protrusion receiving portion defines a movable range of the protrusion and limits a rotation range of the jack, the rotation range of the jack being defined by a first contacting position of the protrusion and the protrusion receiving portion and a second contacting position of the protrusion and the protrusion receiving portion different from the first contacting position of the protrusion and the protrusion receiving portion.

2. The support assembly according to claim 1, wherein the protrusion defines a movable range of the protrusion receiving portion and limits a rotation range of the repetition lever.

3. The support assembly according to claim 1, wherein a range of the protrusion receiving portion in which the protrusion moves defines a movable range of the jack at time of key pressing and time of key releasing.

4. The support assembly according to claim 1, wherein the protrusion receiving portion is a groove or an opening, and a contacting surface to be brought into contact with the protrusion is made from a soft material.

5. The support assembly according to claim 1, wherein the support includes a resin-made structure.

6. The support assembly according to claim 1, wherein the jack includes a resin-made structure.

7. A keyboard apparatus comprising:

a plurality of support assemblies according to claim 1;

a key disposed for each of the support assemblies and provided for rotating the support; and a sound emission mechanism for emitting sound in accordance with pressing of the key.

8. The keyboard apparatus according to claim 7, wherein the sound emission mechanism includes a sound source unit for generating a sound signal according to a key pressing operation.

9. The keyboard apparatus according to claim 7, wherein the sound emission mechanism includes a string generating a sound by being struck by a hammer in accordance with key pressing operation.

* * * * *